United States Patent [19]

Terajima et al.

[11] Patent Number: 4,553,693

[45] Date of Patent: Nov. 19, 1985

[54] BAG-SHAPED CONTAINER WITH A STRAW INSERT HOLE FORMED AND METHOD OF PRODUCING THE SAME

[75] Inventors: Yoshimi Terajima, Ebina; Hiroshi Akitoshi, Zushi; Nobuaki Nagatani, Tokyo, all of Japan

[73] Assignee: Toyo Seikan Kaisha, Ltd., Tokyo, Japan

[21] Appl. No.: 618,116

[22] Filed: Jun. 7, 1984

[30] Foreign Application Priority Data

Feb. 17, 1984 [JP] Japan ..... 59-21433[U]

[51] Int. Cl.[4] ..... B65D 1/08

[52] U.S. Cl. ..... 229/7 S; 220/367; 229/DIG. 14

[58] Field of Search ..... 229/7 S, 7 R, DIG. 14; 206/494; 220/258, 256, 257, 367

[56] References Cited

U.S. PATENT DOCUMENTS

| | | | |
|---|---|---|---|
| 3,951,331 | 4/1976 | Smith et al. | 220/258 |
| 4,072,233 | 2/1978 | Kramer et al. | 229/7 S |
| 4,192,420 | 3/1980 | Worrell, Sr. et al. | 220/258 |
| 4,244,474 | 1/1981 | Wise | 229/7 S |
| 4,397,394 | 8/1983 | Lisiecki | 229/7 S |
| 4,420,080 | 12/1983 | Nakamura | 206/494 |

*Primary Examiner*—Joseph Man-Fu Moy

*Attorney, Agent, or Firm*—Martin A. Farber

[57] ABSTRACT

An improved bag-shaped container with a straw insert hole formed thereon is disclosed. The straw insert hole extends through the body of the container and two sealing pieces are adhered to the inner surface of the body to fully close the straw insert hole. Further, a tab is disposed on the outer surface of the body to fully cover the straw insert hole. When an user wants to take the content out of the container, he first peels the tab and then causes a straw to pierce through the second sealing piece until its foremost end part is inserted into the interior of the container. Thus, he is ready to suck the content in the container. To facilitate piercing of the foremost end part of the straw the sealing piece is formed with a small hole or a weakened portion in the form of score. A method of producing bag-shaped containers with a straw insert hole formed thereon respectively is carried out by way of the steps of punching a straw insert hole on the sheet material, temporarily adhering a first sealing piece to the inner surface of the sheet material to cover the straw insert hole, temporarily adhering a tab to the outer surface of the sheet material, finally adhering the tab to the first sealing piece and adhering a second sealing piece to the inner surface of the sheet material or to the first sealing piece to cover the latter.

6 Claims, 29 Drawing Figures

BAG-SHAPED CONTAINER WITH A STRAW INSERT HOLE FORMED AND METHOD OF PRODUCING THE SAME

BACKGROUND OF THE INVENTION

1. Field of the Invention

The present invention relates to a bag-shaped container with a straw insert hole formed thereon which is used particularly in the form of a self-standing pouch for containing liquid such as juice or the like. Further, the present invention relates to a method of producing bag-shaped containers of the above-mentioned type.

2. Description of the Prior Art

To facilitate understanding of the present invention it will be helpful that a typical conventional self-standing pouch will be briefly described below with reference to FIGS. 1 and 2. As illustrated in the drawings, the self-standing pouch (hereinafter referred to simply as standing pouch) comprises a front surface member 2, a rear surface member 3 and a bottom member 4 and they are heat sealed to one another to such a shape that its lower part has a tubular configuration so as to allow it to stand upright by itself. Material having fludity is contained in the standing pouch to be stored or displayed. When an user wants to take the content out of the standing pouch, he is required to tear the upper part away from the body of the standing pouch by utilizing a notch 5. Then, he sucks the content through a straw or the like means. However, it has been found that a considerably high intensity of force is required for tearing operation and therefore a child can open the pouch only with much difficulties. Another problem is that there often spills content in the pouch due to vibrative movement during tearing operation. In view of the foregoing problems there has been already proposed an improved standing pouch with a straw insert hole preformed thereon but the improved standing pouch has also problems with respect to two functional performances to be achieved as a container, one of them being capability of holding of content and the other one being easiness of handling or using of the standing pouch.

An important thing to be noted when a strip of laminate sheet is employed as sheet material for producing standing pouches is that adhesive, ink or cut edge of aluminum foil are exposed along the inner periphery of a straw insert hole which is formed on the laminate sheet by punching operation. To inhibit the exposed material from coming in contact with content in the pouch there is necessity for developing a new technique. For the reason standing pouch of the early mentioned type which can satisfactorily meet the requirements is not obtained at present. To obviate this problem the inventor proposed a method of producing improved standing pouches with straw insert hole formed thereon and filed an application for patent in Japan under patent application No. 17,837/82. It has been proven that the proposed method brings remarkable improvements but a problem is kept unresolved which is related to blowing of content which tends to occur when a straw insert hole is opened with a tab removed from the body of the pouch. Thus, requests for eliminating this problem have been raised from users.

SUMMARY OF THE INVENTION

The present invention has been made with the foregoing background in mind.

It is an object of the present invention to provide a bag-shaped container with a straw insert hole formed thereon which is used particularly in the form of a self-standing pouch, wherein required functional performances relative to capability of holding of content and easiness of handling or using of the container are reliably obtainable and adhesive, ink and cut edge of aluminum foil exposed along the inner periphery of a straw insert hole which is formed on a strip of laminate sheet by punching operation are inhibited from contact with content in the container and moreover there is no fear of causing blowing of liquid content from the container when the straw insert hole is opened.

It is other object of the present invention to provide a method of producing bag-shaped containers of the foregoing type.

To accomplish the first mentioned object there is proposed according to an aspect of the invention a bag-shaped container with a straw insert hole formed thereon which essentially comprises a body having a straw insert hole formed thereon which extends through the thickness of the body, a first inside sealing piece adhered to the inner surface of the body to fully cover the straw insert hole, a second inside sealing piece adhered to the inner surface of the body or to the area of the first inside sealing piece located offset from the straw insert hole to fully cover the first inside sealing piece, and a tab disposed on the outer surface of the body, the central part of the tab being deformed into the straw insert hole to be adhered to the first inside sealing piece.

To facilitate inserting of a straw the second inside sealing piece is formed with a small hole.

Further, there is proposed according to other aspect of the invention a bag-shaped container with a straw insert hole formed thereon which essentially comprises a body having a straw insert hole formed thereon which extends through the thickness of the body, a first inside sealing piece adhered to the inner surface of the body to fully cover the straw insert hole, a second inside sealing piece adhered to the inner surface of the body or to the area of the first inside sealing piece located offset from the straw insert hole to fully cover the first inside sealing piece, the second inside sealing piece being formed with a weakened portion which is easy to be broken by means of a straw adapted to pierce therethrough, and a tab disposed on the outer surface of the body, the central part of the tab being deformed into the straw insert hole to be adhered to the first inside sealing piece.

Further, to accomplish the last mentioned object there is proposed according to another aspect of the invention a method of producing bag-shaped containers with a straw insert hole formed thereon respectively which is carried out by way of the steps of punching a straw insert hole on a strip of sheet material constituting the body of the container, temporarily adhering a first inside sealing piece to the inner surface of the sheet material to fully cover the straw insert hole, disposing a tab on the outer surface of the sheet material to fully cover the straw insert hole, the central part of the tab being deformed into the straw insert hole to be temporarily adhered to the first inside sealing piece, finally adhering the tab to the first inside sealing piece in the straw insert hole, and adhering a second inside sealing piece to the inner surface of the sheet material to fully cover the first inside sealing piece.

Temporary adhering of the first inside sealing piece may be effected by spot heat sealing at several positions on the inner surface of the sheet material.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

FIG. 8 (*b*) is a fragmental vertical sectional view of the standing pouch in FIG. 7, particularly illustrating the straw insert section after a tab is peeled from the body.

FIG. 10 (*b*) is a fragmental sectional view of the second inside sealing piece taken in line C—C in FIG. 10 (*a*).

FIG. 11 (*b*) is a fragmental sectional view of the second inside sealing piece taken in line D—D in FIG. 11 (*a*).

DESCRIPTION OF THE PREFERRED EMBODIMENTS

Now, the present invention will be described in a greater detail hereunder with reference to FIGS. 3 to 16 which illustrate a few preferred embodiments thereof.

Figure 1:
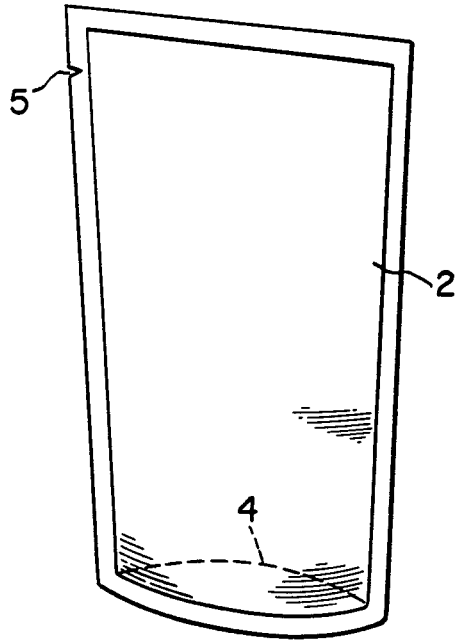
FIG. 1 PRIOR ART
FIG. 1 is a perspective view of a conventional standing pouch.
Figure 2:
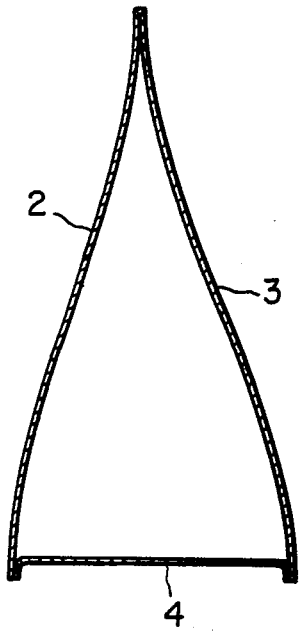
FIG. 2 PRIOR ART
FIG. 2 is a vertical sectional view of the conventional standing pouch in FIG. 1.
Figure 3:
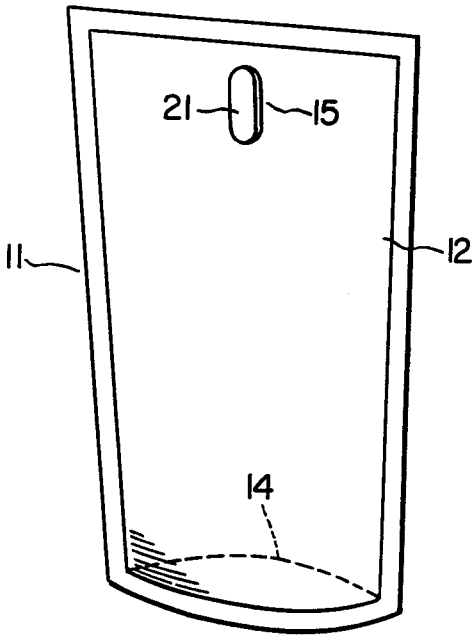
FIG. 3 is a perspective view of a standing pouch in accordance with the first embodiment of the invention.
Figure 4:
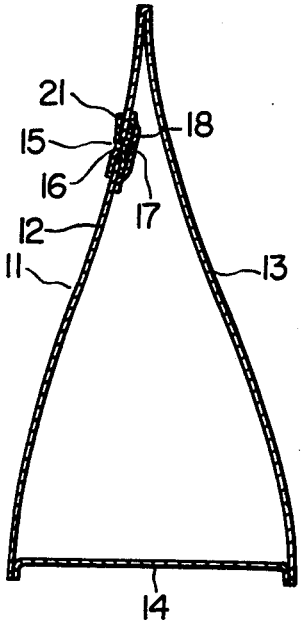
FIG. 4 is a vertical sectional view of the standing pouch in FIG. 3.

Referring to FIGS. 3 and 4 which illustrate the first embodiment of the invention, reference numeral 11 designates a self-standing pouch to which the present invention is applied. As is apparent from the drawings, the self-standing pouch 11 (hereinafter referred to simply as standing pouch) essentially comprises a front surface member 12 having the substantially rectangular configuration, a rear surface member 13 having the substantially rectangular configuration and a bottom member 14 having the substantially elliptic configuration. The front surface member 12 and the rear surface member 13 are heat sealed together along their upper end edge and both side edges and moreover the lower end edge part of both the front and rear surface members 12 and 13 is heat sealed to the circumferential edge part of the bottom member 14. Thus, a container body for the standing pouch is constructed in the above-described manner. The front surface member 12 constituting the container body is provided with a straw insert portion 15 through which the content in the standing pouch can be taken out. Any commercial material available as pouch material can be employed as raw material constituting the front surface member 12, the rear surface member 13 and the bottom member 14.

Figure 5:
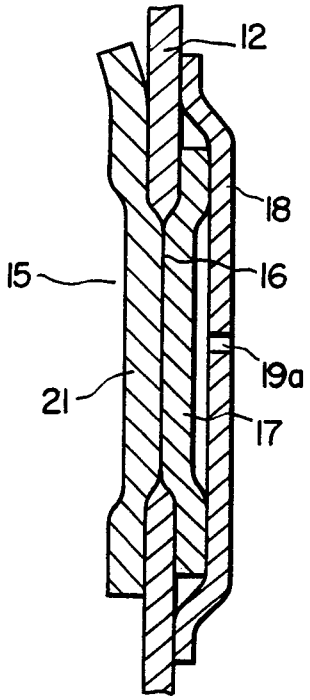
FIG. 5 is a fragmental vertical sectional view of the standing pouch in FIG. 3, particularly illustrating the straw insert section in an enlarged scale.
Figure 7:
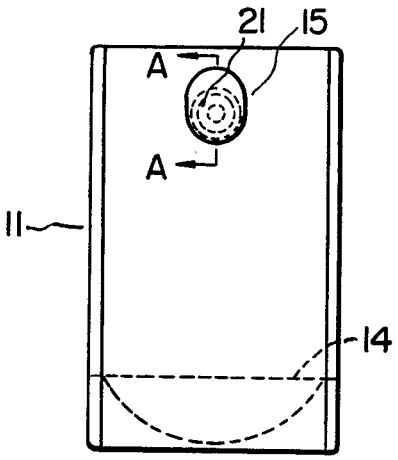
FIG. 7 is a front view of a standing pouch in accordance with the second embodiment of the invention.
Figure 6:
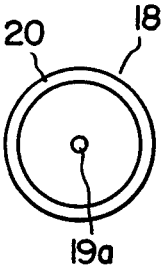
FIGS. 6 (*a*) to (*d*) are a plan view of a second inside sealing piece respectively, particularly illustrating how a small hole is formed thereon.
Figure 6:
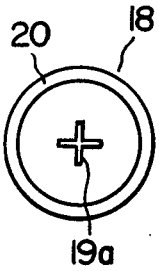
Figure 6:
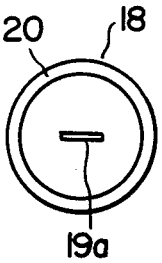
Figure 6:
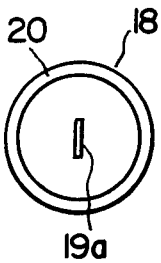
Figure 8:
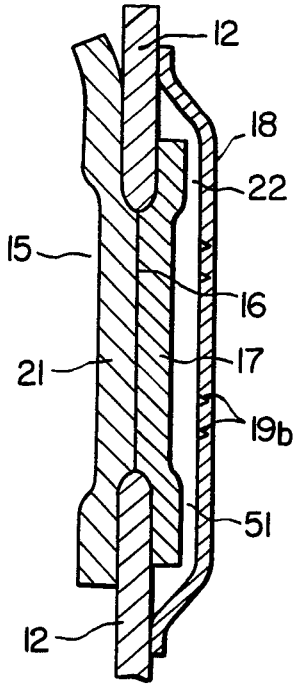
FIG. 8 (*a*) is a fragmental vertical section view of the standing pouch taken in line A—A in FIG. 7, particularly illustrating the straw insert section in an enlarged scale.
Figure 8:
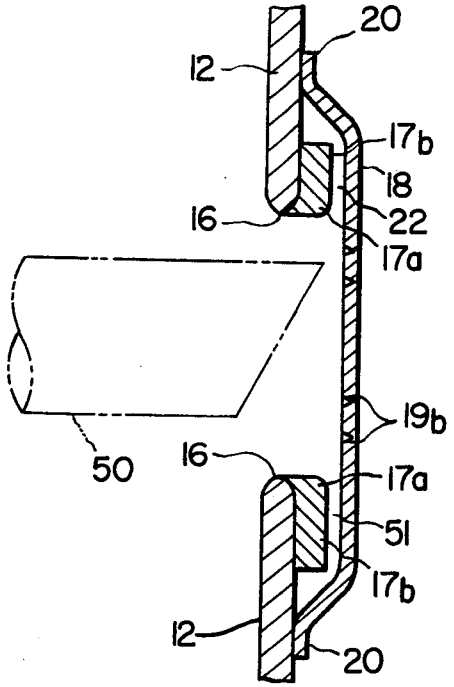

The detailed structure of the straw insert portion 15 is as illustrated in FIG. 5. Specifically, the front surface portion 12 is formed with a straw insert hole 16 through which a straw can be inserted into the interior of the standing pouch and a first inside sealing piece 17 is adhesively attached to the inner surface of the front surface member 12 to fully cover the straw insert hole 16. The first inside sealing piece 17 is made of polyethylene, ethylene acetic acid vinyl copolymer, polypropylene or the like material.

Further, a second inside sealing piece 18 is adhesively attached to the inner surface of the front surface member 12 in such a manner as to fully cover the first inside sealing piece 17. The second inside sealing piece 18 is made also of polyethylene, ethylene acetic acid vinyl copolymer, polypropylene or the like material and to assure that it has such a reduced strength that it can be easily broken by means of a straw adapted to pierce therethrough or that it is easy to be broken, it is formed with a small hole 19*a* of which configuration is as illustrated in FIGS. 6*a* to 6*d*. The second inside sealing piece 18 is adhesively attached to the inner surface of the front surface member 12 along its circumferential part 20.

To fully cover the straw insert hole 16 a tab 21 is disposed on the outer surface of the front surface member 12 and its central portion is deformed in the form of a recess so that it is adhered to the first inside sealing piece 17.

When an user wants to take out the content from the standing pouch as constructed in the above-described manner, he grasps the tab 21 with his fingers and then peels it from the front surface member 12, causing the first inside sealing piece 17 to be broken. Thus, the straw insert hole 16 which has been covered with the latter is opened. At this moment the straw insert hole 16 is still covered with the second inside sealing piece 18. To break it he strikes a straw against it until it pierces therethrough. Now, he is ready to suck the content through the straw.

As will be readily understood from the above description, the standing pouch of the invention has an advantageous feature that the content in it can be very easily taken out. Other advantageous feature is that the standing pouch has an excellent sealability because the straw insert hole 16 is covered with three layers comprising the first inside sealing piece 17, the second inside sealing piece 18 and the tab 21 while the standing pouch is stored in a refrigerator or the like or displayed on a show case or the like. Another advantageous feature is that in case where a straw insert hole is formed by punching a commercial laminate sheet adhesive, ink and cut edge of aluminum foil exposed along the inner periphery of the punched hole are reliably isolated from the interior of the standing pouch with aid of the first inside sealing piece 17. The most important thing to be noted with respect to the standing pouch of the invention is that since the second inside sealing piece 18 serves as a barrier or partition against the content in it, there does not occur exposure of the content immediately after the tab 21 is peeled off, resulting in blowing of the content being inhibited.

Next, description will be made below as to a standing pouch in accordance with the second embodiment of the invention with reference to FIGS. 7 to 12.

Figure 9:
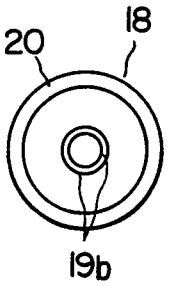
FIGS. 9 (*a*) to (*d*) are a plan view of a second inside sealing piece respectively, particularly illustrating how a weakened portion is formed thereon.
Figure 9:
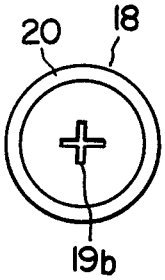
Figure 9:
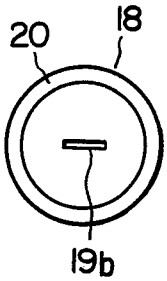
Figure 9:
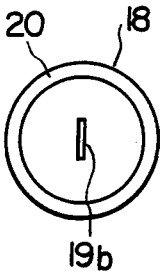
Figure 10:
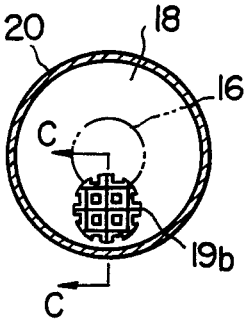
FIG. 10 (*a*) is a plan view of a second inside sealing piece with other type of weakened portion formed thereon.
Figure 10:
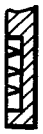

In this embodiment the small hole 19*a* as illustrated in the preceding embodiment is replaced with a weakened portion 19*b* which is easy to be broken by means of a straw. The configuration of the weakened portion 19*b* is as illustrated in FIGS. 9 and 10. In FIGS. 9 (*a*) to (*d*) the weakened portion has a simple configuration in the form of circle, cross, horizontally extending line and vertically extending line. On the other hand, in FIG. 10 (*a*) the weakened portion is formed in the latice-shaped pattern, whereas in FIG. 10 (*b*) it comprises a combination of nine small conical recesses. It has been proven that each of the weakened portions as illustrated in FIGS. 9 and 10 has good appearance and functions satisfactorily. As is apparent from FIG. 8 (*a*) the second inside sealing piece 18 is adhered to the inner surface of the front surface member 12 along the peripheral portion 20 thereof without any occurance of adhesion to the first inside sealing piece 17, while some clearance is kept between the first inside sealing piece 17 and the second inside sealing piece 18 around the peripheral portion 17*a* of the straw insert hole 16.

Figure 12:
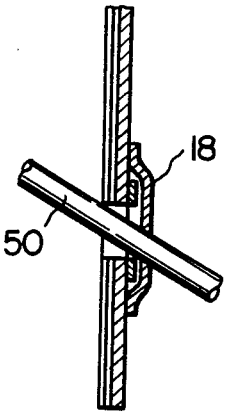
FIG. 12 is a fragmental vertical sectional view of the standing pouch in FIG. 7, particularly illustrating that a straw is inserted into the interior of the pouch in the downwardly inclined state to take the content therefrom.
Figure 11:
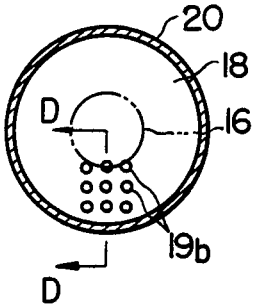
FIG. 11 (*a*) is a plan view of a second inside sealing piece with another type of weakened portion formed thereon.
Figure 11:
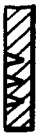

When an user wants to take out the content in the standing pouch as constructed in accordance with the second embodiment, he grasps the tab 21 with his fingers and peels it from the front surface member 12, causing the first inside sealing piece 17 adhered to the tab 21 to be broken. Thus, a straw insert hole 16 is opened (see FIG. 8 (*b*)). However, the straw insert hole 16 is still covered with the second inside sealing piece 18 at this moment. He urges a straw 50 to pierce through the second inside sealing piece 18 as illustrated in FIG. 12 so that he sucks the content in the standing pouch through the straw 50.

As will be readily understood from the above description, content in the standing pouch of the invention can be very easily taken out. Other advantageous feature of the standing pouch is that there does not occur slippage of the foremost end part of a straw outside the hole 16 during piercing operation, because there is provided a clearance 51 between the hole 16 and the second inside sealing piece 18. Thus, any child can handle the standing pouch without particular trouble or difficulty.

In the second embodiment as described above the weakened portion on the second inside sealing piece 18 is formed in the form of score but the present invention should not be limited only to this. Alternatively, the weakened portion may be prepared by embossing operation or in the form of perforations which do not extend through the bottom of the second inside sealing piece. Further, the weakened portion as illustrated in FIGS. 9 (*a*) to (*d*) is formed in the symmetrical pattern relative to the center of the straw insert hole 16. Alternatively, it may be located at the area located below the center of the straw insert hole 16 as illustrated in FIGS. 10 (*a*) and (*b*). In last mentioned case the positional relation between the straw insert hole 16 and the straw 50 is as illustrated in FIG. 12. As is aparent from the drawing, the straw 50 is inserted into the interior of the standing pouch at a certain downward inclination angle and it has been proven that this inclined posture is very effective when an user sucks content in the standing pouch while a straw inserted therein is stably held. In the second embodiment as illustrated in the drawings the peripheral portion 20 of the second inside sealing piece 18 is adhered to the inner surface of the front surface member 12 but the present invention should not be limited only to this. Alternatively, the peripheral portion 20 of the second inside sealing piece 18 may be adhered to the peripheral portion 17*b* of the first inside sealing piece 17 in such a manner that a certain clearance 51 is kept between the the peripheral portion 17*a* of the straw insert hole 16 and the second inside sealing piece 18.

The following examples of the material of the standing pouch may be considered as exemplary of the invention:

EXAMPLE I

As the standing pouch for containing coffee, soup or the like to which the retort processing is adapted:

Sheet material for producing the front surface member, the rear surface member and the bottom member: laminated sheet of 12μ thick polyethylene terephthalate, 15μ thick nylon, 7μ thick aluminum foil and 50μ thick polypropylene.

Sheet material for producing the tab member: laminated sheet of 12μ thick polyethylene terephthalate, 25μ thick nylon, 7μ thick aluminum foil and 80μ thick polypropylene.

Sheet material for producing the first inside sealing piece: 70μ thick polypropylene.

Sheet material for producing the second inside sealing piece: 30μ thick polypropylene.

EXAMPLE II

As the standing pouch for containing juice or the like to which the hot pack processing is adapted:

Sheet material for producing the front surface member, the rear surface member and the bottom member: laminated sheet of 12μ thick polyethylene terephthalate, 20μ thick low density polyethylene, 25μ thick high density polyethylene, 7μ thick aluminum foil and 80μ thick ethylene acetic acid vinyl copolymer.

Sheet material for producing the tab member: laminated sheet of 12μ thick polyethylene terephthalate, 25μ thick nylon, 7μ thick aluminum foil, 20μ thick low density polyethylene, and 30μ thick ethylene acetic acid vinyl copolymer.

Sheet material for producing the first inside sealing piece: 80μ thick ethylene acetic acid vinyl copolymer.

Sheet material for producing the second inside sealing piece: 40μ thick ethylene acetic acid vinyl copolymer.

Next, description will be made below as to a method or producing bag-shaped containers in the form of a self-standing pouch.

The method of the invention includes the steps of cutting three members comprising a front surface member, a rear surface member and a bottom member from a strip of laminate sheet suitably employable for producing standing pouches, each of the members having a predetermined configuration, heat sealing their peripheral edges together and finally cutting the heat sealed members to a required bag-shaped configuration. It should be noted that each of the above-described steps are carried out by utilizing the conventional technique and devices or apparatus without any change or modification made therefor. A characterizing feature of the invention consists in how the straw insert portion is formed.

Specifically, a strip of laminate sheet 30 is punched by cooperatively actuating a punch 22 and a die 23 so that a straw insert hole 16 is formed (see FIG. 12 (*a*)). As required, formation of the straw insert hole 16 is confirmed by detecting it with the aid of any conventional inspecting device or apparatus such as photoelectric tube, optical detecting instrument or the like.

Next, a strip of sheet material 24 for preparing first inside sealing pieces is located below the laminate sheet 30 in parallel with the latter and a first inside sealing piece 17 is punched by actuating a punch 25. Thereafter, the thus punched first inside sealing piece 17 is raised up to such an elevated position where it comes in abutment against the lower surface of the laminate sheet 30 under the influence of upward thrusting force to fully cover the straw insert hole 16. Then, the first inside sealing piece 17 is heat sealed to the laminate sheet 30 by cooperatively actuating an upper heat bar 26 and a lower heat bar 27 until the former is temporarily adhered to the latter (see FIG. 13 (*b*)). In the illustrated case the first inside sealing piece 17 is temporarily heat sealed to the laminate sheet 30 along the whole periphery thereof but the present invention should not be limited only to this. Alternatively, the former may be secured to the latter at several positions by spot heat sealing and this type of temporary adhesion is more preferable from the viewpoint of assuring that air is reliably escaped during temporary adhesion of a tab 21 and final adhesion to be described later. After completion of the above-described step the first inside sealing piece 17 is temporarily heat sealed to the laminate sheet 30, as illustrated in FIG. 14. As required, temporary heat sealing of the first inside sealing piece 17 to the laminate sheet 30 is confirmed by detecting the former with the aid of any conventional inspecting device or apparatus such as pneumatic inspecting device or the like.

Next, a strip of sheet material 28 for preparing tabs is located above the laminate sheet 30 in parallel with the latter and a tab 21 is punched by actuating a punch 29. Thereafter, the thus punched tab 21 is lowered to such a position where it comes in abutment against the upper surface of the laminate sheet 30 under the influence of downward thrusting force to fully cover the straw insert hole 16. Then, the tab 21 is heat sealed to the laminate sheet 30 by cooperatively actuating an upper heat bar 31 and a lower heat bar 32 until the former is temporarily adhered to the latter (see FIG. 13 (*c*)).

Figure 15:
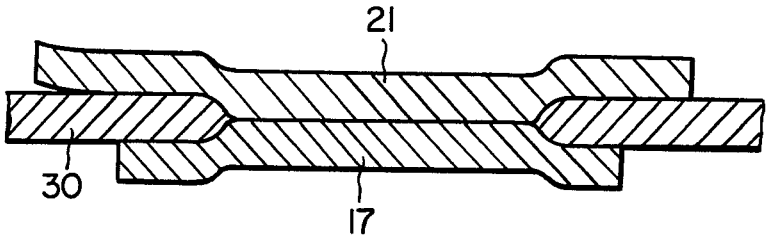
FIG. 15 is a fragmental sectional view of the standing pouch in FIG. 14, illustrating that the tab is temporarily adhered to the first inside sealing piece.

After completion of the above-described steps the first inside sealing piece 17 and the tab 21 are temporarily adhered to the laminate sheet 30 as illustrated in FIG. 15.

Figure 13:
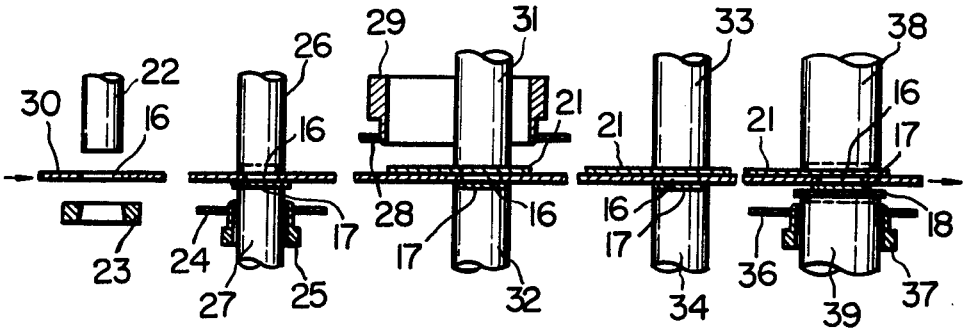
FIGS. 13 (*a*) to (*e*) are a schematic illustration respectively, illustrating how the method of the invention is carried out step by step.
Figure 14:
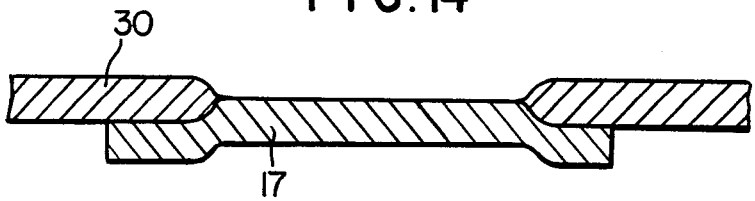
FIG. 14 is a fragmental sectional view of a standing pouch, illustrating that a first inside sealing piece is temporarily adhered to the inner surface of the body.

Next, both the first inside sealing piece 17 and the tab 21 are finally heat sealed by cooperatively actuating an upper heat bar 33 and a lower heat bar 34 (see FIG. 13 (*d*)).

Next, a strip of sheet material 36 for preparing second inside sealing pieces is located below the laminate sheet 30 in parallel with the latter and a second inside sealing piece 18 is punched by actuating a punch 37. Thereafter, the thus punched second inside sealing piece 18 is raised up to such an elevated position where it comes in abutment against the lower surface of the laminate sheet 30 under the influence of upward thrusting force to fully cover the first inside sealing piece 17. Then, the second inside sealing piece 18 is heat sealed to the laminate sheet 30 by cooperatively actuating an upper heat bar 38 and a lower heat bar 39 (see FIG. 13 (*e*)).

Figure 16:
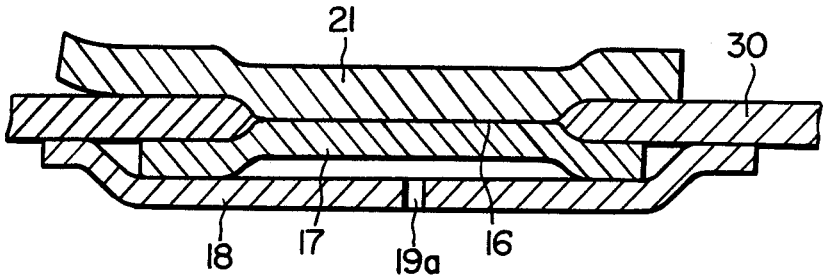
FIG. 16 is a fragmental sectional view of the standing pouch in FIG. 14, illustrating that the second inside sealing piece is adhered to the inner surface of the body to fully cover the first inside sealing piece.

Thus, after completion of the above-described steps a straw insert portion 15 is finished as illustrated by way of a sectional view in FIG. 16. It should be noted that in the above-described embodiment of the method the steps of punching a first inside sealing piece, a tab and a second inside sealing piece are included in the steps for their temporary adhering or heat sealing, but the present invention should not be limited only to this. Alternatively, heat sealing step may be accomplished separately from punching step.

Obviously, a temperature at which each of the heat bars is kept hot is determined lower than melting point of sheet material to which they are to be brought in contact for heat sealing.

Assumed that an outer layer of the tab 21 and an outer layer of the laminate sheet 30 are constituted by the same material (for instance, polyethylene) and an inner layer of the tab 21, an inner layer of the laminate sheet 30, the whole first inside sealing piece 17 and the whole second inside sealing piece 18 are constituted by the same material (for instance, polyethylene or polypropylene), the following relation will be generally established among them.

$$\theta_{MTo}=\theta_{MPo}>>\theta_{MTi}=\theta_{MPi}=\theta_{ML}$$

where

- $\theta_{MTo}$ designates a melting point of material for an outer layer of the tab 21,
- $\theta_{MTi}$ designates a melting point of material for an inner layer of the tab 21,
- $\theta_{MPo}$ designates a melting point of material for and outer layer of the laminate sheet 30,
- $\theta_{MPi}$ designates a melting point of material for an inner layer of the laminate sheet 30, and
- $\theta_{ML}$ designates a melting point of material constituting both the first inside sealing piece 17 and the second inside sealing piece 18.

As will be readily understood from the above description, the method of the invention of producing standing pouches with a straw insert hole formed thereon respectively can be simply carried out by utilizing the conventional steps for producing bag-shaped containers without any change or modification made therefor. Accordingly, the method is easy to be employed and a first inside sealing piece, a tab and a second inside sealing piece can be reliably attached to the laminate sheet in accordance with the predetermined order.

While the present invention has been described above with respect to typical embodiments, it should of course be understood that it should not be limited only to them but various changes or modifications may be made in a suitable manner without any departure from the spirit and scope of the invention.

What is claimed is:

1. A bag-shaped container with a straw insert hole formed thereon comprising;

a body having a straw insert hole formed thereon, said straw insert hole extending through the thickness of the body, a first inside sealing piece adhered to the inner surface of the body to fully cover the straw insert hole, a second inside sealing piece adhered to the inner surface of the body or to the area of the first inside sealing piece located offset from the straw insert hole to fully cover the first inside sealing piece, and a tab disposed on the outer surface of the body, the central part of said tab being deformed into the straw insert hole to be adhered to the first inside sealing piece.

2. A bag-shaped container with a straw insert hole formed thereon as defined in claim 1, wherein the second inside sealing piece is formed with a small hole.

3. The bag-shaped container with a straw insert hole formed thereon as set forth in claim 1, wherein the second inside sealing piece is formed with a weakened portion easily broken by a straw adapted to pierce therethrough.

4. The bag-shaped container with a straw insert hole formed thereon as set forth in claim 3, wherein the second inside sealing piece is formed with a small hole.

5. A method of producing bag-shaped containers with a straw insert hole formed thereon respectively, said method comprising the steps;

punching a straw insert hole on a strip of sheet material constituting the body of the container, temporarily adhering a first inside sealing piece to the inner surface of the sheet material to fully cover the straw insert hole, disposing a tab on the outer surface of the sheet material to fully cover the straw insert hole, the central part of said tab being deformed into the straw insert hole to be temporarily adhered to the first inside sealing piece, finally adhering the tab to the first inside sealing piece in the straw insert hole, and adhering a second inside sealing piece to the inner surface of the sheet material to fully cover the first inside sealing piece.

6. A method of producing bag-shaped containers with a straw insert hole formed thereon, as defined in claim 4, wherein temporary adhering of the first inside sealing piece is effected by spot heat sealing at several positions on the inner surface of the sheet material.

* * * * *